United States Patent [19]

Austin

[11] Patent Number: 5,024,338

[45] Date of Patent: Jun. 18, 1991

[54] DRAPE ROD ASSEMBLY

[76] Inventor: Griffith D. Austin, Rte. 2, Box 143, Vilas, N.C. 28092

[21] Appl. No.: 322,897

[22] Filed: Mar. 14, 1989

[51] Int. Cl.[5] ..... A47H 1/02

[52] U.S. Cl. ..... 211/105.1; 211/105.2

[58] Field of Search ..... 211/105.1, 105.2, 123; 403/292, 295, 297, 65, 353; 16/382, 383, 384, 114; 160/132

[56] References Cited

U.S. PATENT DOCUMENTS 2,386,691 10/1945 Keshey ..... 211/105.2

4,824,062 4/1989 Wagner ..... 211/105.1

FOREIGN PATENT DOCUMENTS 2557387 6/1977 Fed. Rep. of Germany ..... 248/265

2040386 8/1980 United Kingdom ..... 403/295

*Primary Examiner*—Blair M. Johnson

*Attorney, Agent, or Firm*—David M. Carter

[57] ABSTRACT

There is provided a pair of plates swivelably connected together forming a hinge. The hinge is used to join a pair of drape rods so that the drape rods may be mounted at various angles with respect to each other and presenting continuity at corners.

6 Claims, 4 Drawing Sheets

DRAPE ROD ASSEMBLY

BACKGROUND OF THE INVENTION

This invention relates to drape rod assemblies. More particularly, it relates to drape rod application where there is an angle involved between adjacent drape rods.

In many buildings and in many homes, adjacent windows are often constructed at angles with respect to one another such as, for example, bay windows and corner windows. These angles have presented a problem when applying drape or curtain treatments to the windows. Drape rods are normally straight and bending the rods around angles will not provide suitable results. The rods become weakened and the appearance of a bent rod is unsightly.

These problems have become exacerbated by the introduction of the new wide vertically oriented curtain rods referred to as "valance rods." These valance rods range from two and one-half inches to four and one-half inches in width. For applications to windows which are at angles, a separate rod is mounted over each window with each rod bracket having to be bent in such a fashion so that the rod ends appear to meet each other at the proper points. This bending of end brackets must be done because of limited mounting surfaces often encountered in angle windows. The desired effect is continuity between all rods.

OBJECTS OF THE INVENTION

It is therefore one object of this invention to provide an improved drape rod assembly.

It is another object to provide a drape rod assembly which may be used to treat windows which are at angles with respect to one another such as, for example, bay windows or corner windows, with continuity between rods.

SUMMARY OF THE INVENTION

In accordance with one form of this invention, there is provided a drape rod assembly which includes first and second elongated drape rods each of which supporting drapery material. A hinge is provided. The first and second elongated drape rods are connected together by the hinge forming a continuous mounting structure for the drapery material, thus the first and second rods may be mounted at various angles with respect to each other thereby presenting an uninterrupted appearance for the drapery material.

In another form of this invention there is provided a connector for coupling a pair or more of drape rods. The connector includes a first plate with at least one locking tab projecting from the first plate. The connector includes a second plate with a second locking tab projecting from the second plate. A mechanism is provided for swivelably connecting the first and second plates together enabling the plates to rotate relative to one another. The rods may thus be readily mounted in various angles with respect to one another. Preferably the connector is at a width no greater than the width of the rods so that drapery material may be readily slipped over the connector.

BRIEF DESCRIPTION OF THE DRAWINGS

The subject matter which is regarded as the invention is set forth in the appended claims. The invention itself, however, together with further objects and advantages thereof, may be better understood by reference to the accompanying description taken in conjunction with the accompanying drawings in which:

DESCRIPTION OF THE PREFERRED EMBODIMENT

Figure 1:
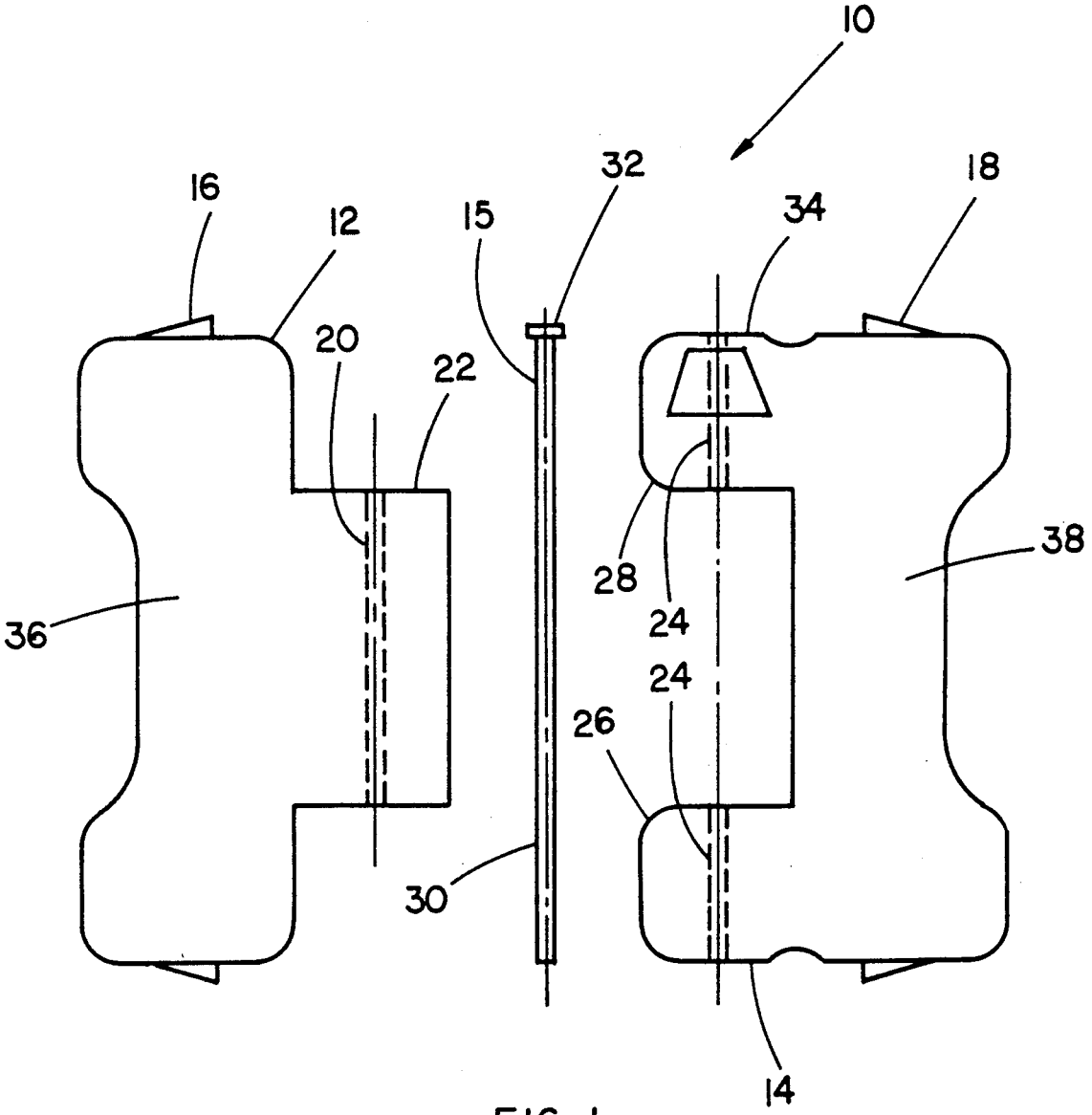
FIG. 1 is an exploded pictorial view of the apparatus of the subject invention.

Referring now more particularly to FIG. 1, there is provided connector 10 shown exploded in three primary parts, namely, plate 12, plate 14, and pin 15. Plate 12 includes a pair of tabs 16 and 16. The tabs project from plate 12 for insertion into a corresponding slot in the end of the curtain rod. Plate 14 includes a corresponding pair of tabs 18 and 19 also for insertion into the slots in an adjacent curtain rod. These tabs lock the connector into the adjacent curtain rods and tie the curtain rods together.

Plate 12 includes bore hole 20 extending vertically through portion 22 of the plate. Plate 14 includes bore hole 24 extending through portions 26 and 28 of the plate. Bore holes 20 and 24 align with one another and receive pin 15 which includes rod portion 30 and head 32. Countersink pinhead 32 abuts against the top portion 34 of plate 14 to hold the pin in place. The pin enables the plates to act as a hinge in that the plates will swivel with respect to one another. This hinge action enables adjacent rods to be mounted at various angles with respect to one another so that when adjacent windows are at angles such as, for example, bay windows or corner windows, the adjacent rods present a continuous appearance. The end portions 36 and 38 of the respective plates are received in the ends of respective adjacent curtain rods.

Figure 2:
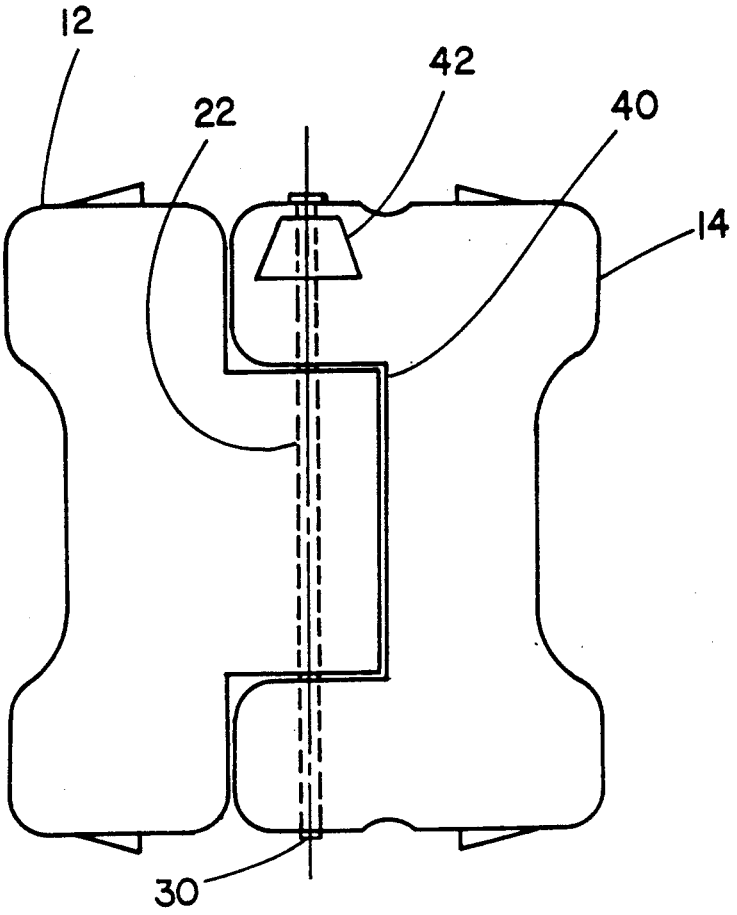
FIG. 2 is a front elevational view of the apparatus of FIG. 1 having been assembled.
Figure 3:
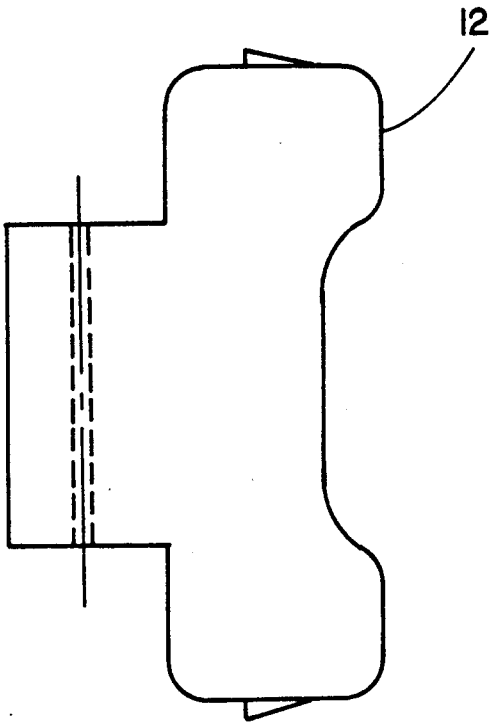
FIG. 3 is a rear elevational view showing one of the plates forming a portion of the apparatus of FIG. 1.

Referring now to FIG. 2 which shows the connector or hinge 10 assembled, portion 22 of plate 12 essentially fits into the cutout portion 40 of plate 14. Bore hole 20 of plate 12 aligns with bore hole 24 of plate 14 so that pin 15 is readily received in the bore holes. Slot or hood 42 forms a part of plate 14 for receiving a portion of a support bracket which will be explained below, which may or may not need to be used, depending on installation requirements.

Figure 4:
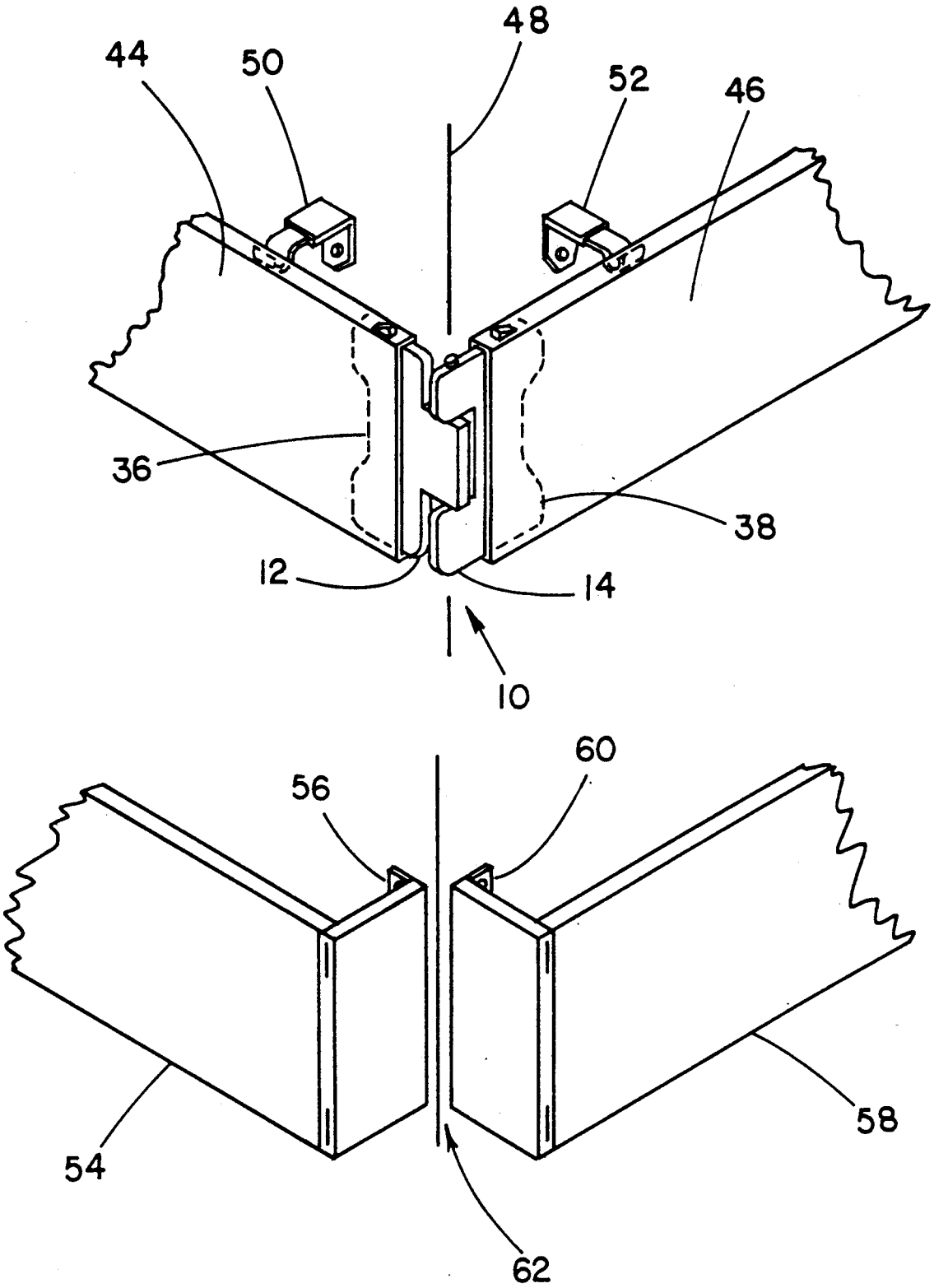
FIG. 4 is a partial pictorial view of the apparatus of FIG. 2 connecting a pair of rods together in an outside corner window application as well as the prior art treatment.

Referring now to FIG. 4 drape rods 44 and 46 are mounted in outside corner 48 forming a 90° angle. For simplicity's sake, the adjacent windows are not shown. A connector or hinge 10 connects the rods 44 and 46 together in corner 48. End portion 36, which is shown in outline, of plate 12 is received inside of rod 44 and end portion 38 of plate 14, which also is shown in outline, is received inside of rod 46. The hinge has been swiveled to a 90° angle to accommodate the angle between the two adjacent rods.

In the embodiment shown in FIG. 4, because of the 90° angle corner there is no mounting bracket connected to hinge 10. However, standard mounting bracket center supports 50 and 52 are connected to rods 44 and 46, respectively, to provide support for the rods. These brackets can be used to support rods at any point along the rod. The remainders of the rods are not shown, however support for the other ends of the rods is provided by standard end cap mounting brackets.

FIG. 4 also shows a comparison of the prior art technique of mounting curtain rods in a corner. Rod 54 includes end cap mounting bracket 56 and rod 58 includes end cap mounting bracket 60. For such outside 90° angles, standard end brackets can be mounted only as far as mounting surface allows, creating a gap between two or more rods, making two independent rods necessary.

Figure 5:
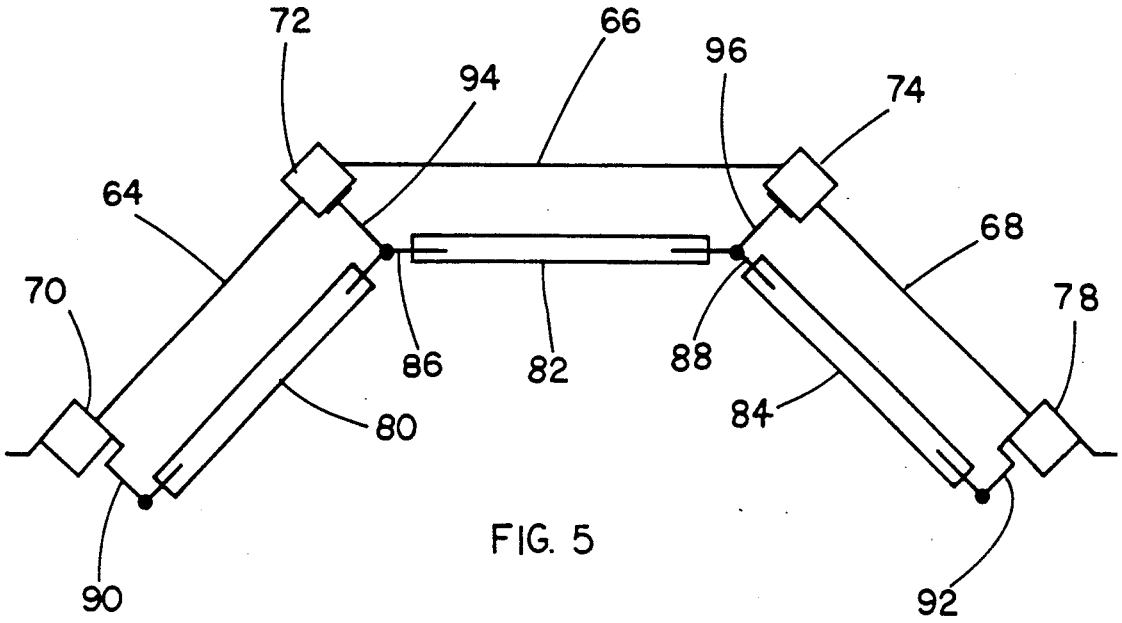
FIG. 5 is a top view of a schematic showing of the system of the subject invention in a bay window application.

Referring now to FIG. 5, which shows a general schematic using Applicant's invention in a system for use with a bay window, windows 64, 66, and 68 are provided each of which is at an angle with respect to its adjacent window. Wooden separators or mullions 70, 72, 74, and 78 are provided, with separators 72 and 74 being located between adjacent windows. Curtain rods 80, 82 and 84 are connected together by connectors or hinges 86 and 88 which are the same hinge 10 shown in FIG. 2. End brackets 90 and 92 are mounted to wooden separators 70 and 78 forming the ends of the rods. Mounting brackets 94 and 96 are respectively connected between separator 72 and hinge 86 and between separator 74 and hinge 88. The connection is made to slot 42 shown in FIG. 2. The angles of the hinges have been adjusted to fit the angles between each adjacent bay window.

Figure 6:
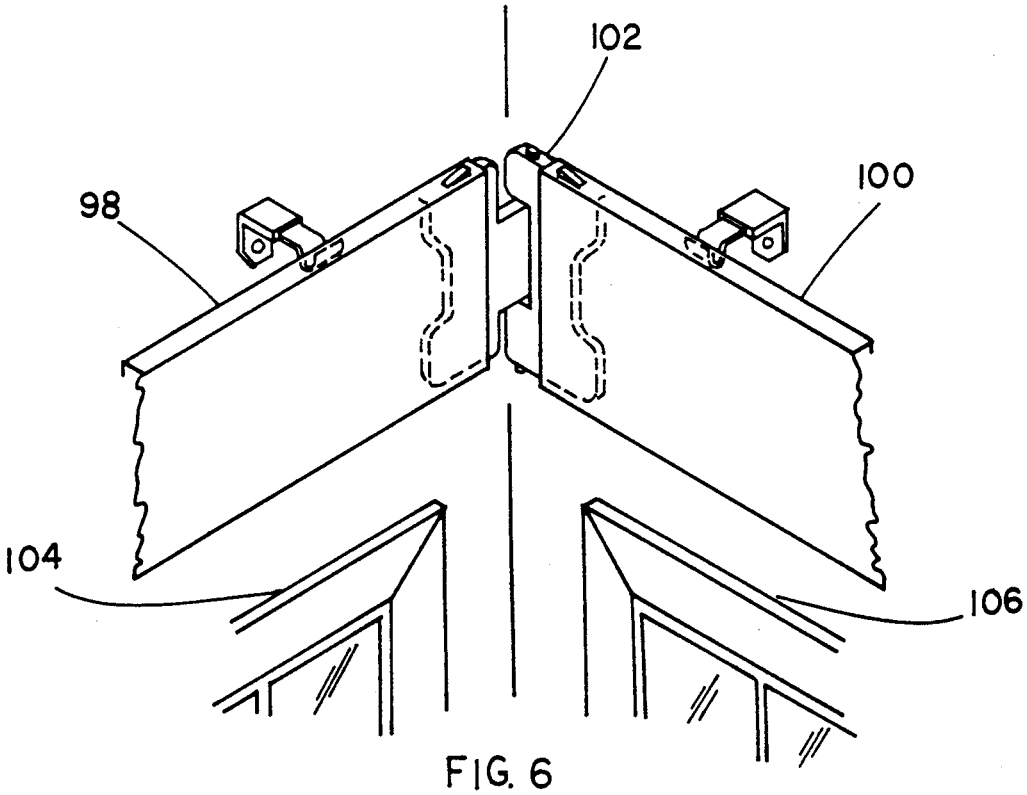
FIG. 6 is a partial pictorial view of the apparatus of FIG. 2 connecting a pair of rods together in an inside window application.

Referring now to FIG. 6, rods 98 and 100 are connected together at an inside 90° corner by hinge 102. The rods are mounted over corner windows 104 and 106. Two end brackets are eliminated and thus potential mounting problems are eliminated and one continuous rod assembly is presented.

As can be seen from FIGS. 4, 5, and 6, a drape may be readily pulled over the hinges without resulting in a discontinuity at the angles. A one piece rod and thus valance and/or drapery is presented. Furthermore in a bay window application as shown in FIG. 5, by using two hinges 86 and 88, the need for four additional end brackets is eliminated, i.e. one end bracket each for rods 80 and 86 and two end brackets for rod 82. Also the need to bend end brackets is eliminated.

From the foregoing description and the preferred embodiment of the invention, it is apparent that many modifications may be made therein without departing from the true spirit and scope of the invention.

I claim:

1. A drape rod assembly comprising:

first and second elongated drape rods each of which supporting drapery material;

a hinge; said first and second elongated drape rods connected together by said hinge forming a continuous mounting structure for said drapery material whereby said first and second elongated drape rods may be mounted at various angles with respect to each other thereby presenting an uninterrupted appearance for said drapery material; said hinge including first and second members and means for rotatably holding said members together thereby enabling said members to be moved relative to one another; each elongated drape rod including a receptacle on at least one end; at least a portion of said first member received in said receptacle of said first elongated drape rod and at least a portion of said second member received in said receptacle of said second elongated drape rod; each member having a pair of tabs; said tabs received in respective receptacles.

2. A drape rod assembly comprising:

first and second elongated drape rods each of which supporting drapery material;

a hinge; said first and second elongated drape rods connected together by said hinge forming a continuous mounting structure for said drapery material whereby said first and second elongated drape rods may be mounted at various angles with respect to each other thereby presenting an uninterrupted appearance for said drapery material;

a first bracket; said first bracket connected to said first elongated rod;

a second bracket; said second bracket connected to said second elongated rod; said first and second brackets adapted to be mounted to respective surfaces.

3. An assembly as set forth in claim 2 wherein said hinge is adapted to swivel whereby the angle between said elongated drape rods may be varied between 0° and 340°.

4. An assembly as set forth in claim 2 further including a third rod and a second hinge; said second and third rods connected together by said second hinge.

5. An assembly as set forth in claim 4 wherein said first, second and third elongated drape rods are mounted in a bay window.

6. An assembly as set forth in claim 2 wherein said first and second elongated drape rods are mounted in a corner.

* * * * *